US005198628A

United States Patent [19]

Bitko

[11] Patent Number: 5,198,628

[45] Date of Patent: Mar. 30, 1993

[54] SHOCK INSENSITIVE TILT SWITCH WITH FLOATING SPHERICAL RESTRICTOR TO INHIBIT FLOW OF CONDUCTIVE LIQUID

[75] Inventor: Sheldon S. Bitko, East Brunswick, N.J.

[73] Assignee: Fifth Dimension, Inc., Trenton, N.J.

[21] Appl. No.: 895,845

[22] Filed: Jun. 9, 1992

[51] Int. Cl.[5] ..... H01H 35/14

[52] U.S. Cl. ..... 200/61.47; 200/61.52; 200/190; 200/220; 200/230

[58] Field of Search ..... 200/61.47, 61.52, 182-236

[56] References Cited

U.S. PATENT DOCUMENTS

| | | | |
|---|---|---|---|
| 1,907,402 | 5/1933 | Fedor | 200/230 |
| 2,273,921 | 2/1942 | Bain | 337/122 |
| 3,184,566 | 5/1965 | Kleinpeter | 200/230 |
| 3,240,900 | 3/1966 | Halff et al. | 200/190 |
| 3,673,524 | 6/1972 | Lowry | 335/52 |
| 3,914,567 | 10/1975 | Reinnagel | 200/230 |
| 4,099,040 | 7/1978 | Bitko | 200/220 |
| 4,135,067 | 1/1979 | Bitko | 200/61.52 |

*Primary Examiner*—J. R. Scott

*Attorney, Agent, or Firm*—Burns, Doane, Swecker & Mathis

[57] ABSTRACT

A tilt switch comprises a housing forming a cylindrical inner chamber and having two electric terminals extending through an end wall of the chamber. A mercury mass of less volume than the chamber is disposed within the chamber and is arranged to electrically interconnect the terminals when the switch is in a first position relative to vertical, and to break the electrical contact when the switch is tilted to a second position relative to vertical. A spherical body of less density than the liquid and including a non-electrically conductive outer surface floats upon a surface of the liquid and is pushed upwardly against a surface of the chamber. The spherical body has a smaller diameter than the diameter of the chamber to define a restriction passage which inhibits the flow of liquid when the switch is subjected to shock.

13 Claims, 1 Drawing Sheet

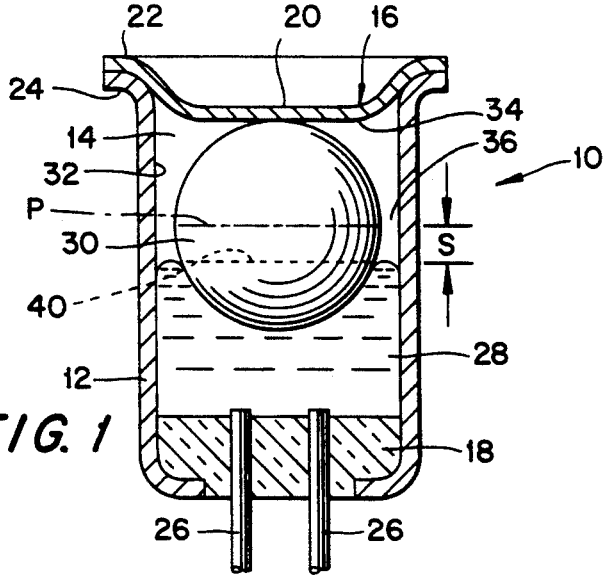
FIG. 1
FIG. 2
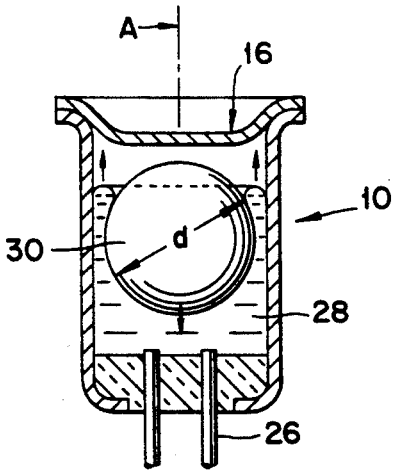
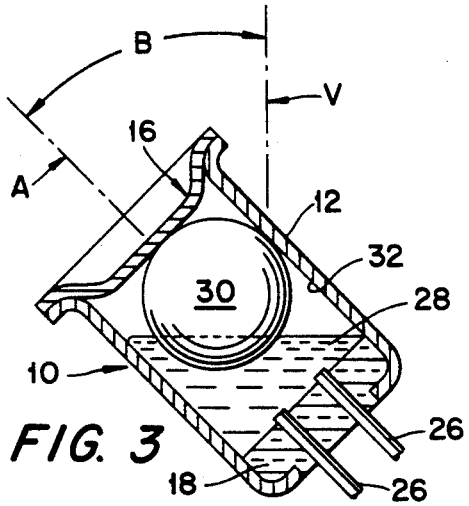
FIG. 3
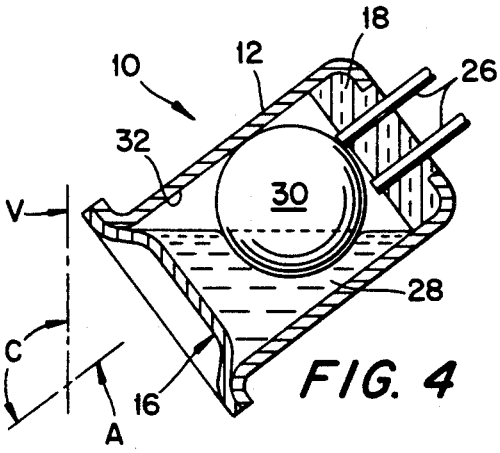
FIG. 4
FIG. 5
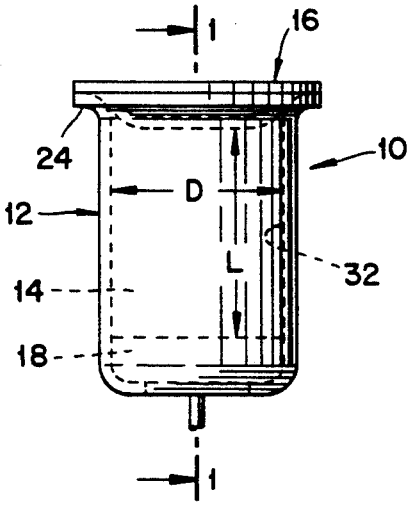

SHOCK INSENSITIVE TILT SWITCH WITH FLOATING SPHERICAL RESTRICTOR TO INHIBIT FLOW OF CONDUCTIVE LIQUID

BACKGROUND OF THE INVENTION

The present invention relates to tilt switches which open or close an electric circuit when the switch is subjected to a predetermined angle of tilting.

Such a tilt switch is disclosed, for example, in Bitko U.S. Pat. No. 4,090,040 issued Jan. 16, 1979. A switch disclosed therein comprises a housing forming an internal chamber. One or more electrical terminals extend into the chamber. A mass of electrically conductive liquid, such as mercury, is disposed within the chamber and is movable between positions in and out of contact with the electric terminal(s) in response to tilting of the switch housing.

A tilt switch of that type is capable of providing a signal when an object to which the switch is attached is tilted by a predetermined angle. A shortcoming of such a tilt switch becomes evident in cases where the tilt switch is subjected to shock, such as a momentary impact or prolonged vibration of such magnitude as to cause the mercury to bounce around within the chamber and intermittently open and close the contacts.

To avoid that problem, it has previously been proposed to fill the rest of the chamber with a damping fluid, such as oil. The mercury is denser than the oil and thus still behaves in the above-described manner, except that the oil tends to dampen the movement of the mercury and thus eliminate the ability of the mercury to bounce around in the chamber. However, a shortcoming of that type of switch involves the fact that in response to shock, the mercury tends to fragment into small spheroids, whereby the switch is inoperable until the spheroids coalesce back into a unified mass. In the absence of damping oil, the spheroids would coalesce quickly, but in the presence of the damping oil, the coalescence of the spheroids is retarded and can take a considerable period of time, depending upon the number and size of the spheroids, as well as upon the viscosity of the damping oil.

Therefore, it will be appreciated that mercury tilt switches have not been particularly useful in cases where the switch would be expected to encounter appreciable shock.

SUMMARY OF THE INVENTION

The present invention alleviates the aforementioned shortcomings by providing a tilt switch which comprises a housing that forms a closed internal chamber. An electrically conductive liquid of less volume than the chamber is disposed within the chamber. Electric terminals are arranged to be electrically interconnected by the liquid when the switch is in a first position relative to vertical. The liquid breaks the electric connection with the switch is tilted to a second position relative to vertical. A body of less density than liquid floats on a surface of the liquid and is pushed upwardly against a surface of the chamber by the liquid. The body has a non-electrically conductive surface and is of smaller cross-section than the chamber to define restriction passage means for inhibiting the flow of liquid therepast when the switch is subjected to shock. Preferably, the outer surface of the body is convexly curved as the body is viewed in longitudinal section along a longitudinal axis of the switch. Preferably, the internal chamber is of cylindrical configuration, and the body is spherical with the outer diameter smaller than the diameter of the chamber.

The electric terminals preferably comprise two terminals extending through one end of the chamber.

BRIEF DESCRIPTION OF THE DRAWINGS

The objects and advantages of the invention will become apparent from the following detailed description of a preferred embodiment thereof in connection with the accompanying drawings in which like numerals designate like elements, and in which:

FIG. 1 is a longitudinal sectional view taken along the line 1—1 in FIG. 5 of a tilt switch according to the present invention, when the switch is at rest in a vertical position;

FIG. 2 is a view similar to FIG. 1 after the switch has been subjected to a shock;

FIG. 3 is a view similar to FIG. 1 after the switch has been tilted about an acute axis;

FIG. 4 is a view similar to FIG. 1 after the switch has been tilted by an obtuse angle; and FIG. 5 is a side elevational view of the tilt switch according to the present invention.

DETAILED DESCRIPTION OF A PREFERRED EMBODIMENT OF THE INVENTION

A mercury tilt switch 10 depicted in the attached figures comprises a generally cylindrical housing 12 which defines an internal chamber 14. The chamber 14 is closed-off at its upper end by a cap 16 and at its lower end by a glass seal 18.

The cap 16 is generally dish-shaped and includes a recessed center portion 20 surrounded by an outer peripheral flange 22. That flange 22 is joined, e.g., by welding, to a flange 24 formed at an upper end of the housing 12. Two electric terminals 26 extend through the glass seal 18 and project into the chamber 14.

Situated within the chamber 14 is a spherical body 30 and a mass of electrically conductive liquid, such as a mercury mass 28. The mercury 28 is of less volume than the chamber 14. The body 30 is formed of a material of less density than the liquid 28, whereby the spherical body floats freely on the liquid 28. At least the outer surface of the body 30 is non-electrically conductive.

The spherical body 30 has a diameter d which is slightly smaller than the inner diameter D of the chamber 14 (see FIG. 5) defined by an internal surface 32 of the housing. The diameter d of the body 30 is appreciably smaller than the length L of the chamber 14. Those parameters d, L and the volume of the mercury mass 28 are chosen such that the mercury is able to push the spherical body upwardly against the top surface 34 of the chamber 14 (defined by the underside of the cap 16) when the switch is in a vertical position (see FIG. 1).

In effect, the cap 16 pushes the spherical body 30 into the surface of the mercury, thereby creating downward surface tension forces acting on the mercury. The surface tension forces react against the spherical body as an upward lifting or buoyancy force. When a shock creates a force acting upon the switch in a manner tending to urge the mercury mass 28 and the spherical body 30 upwardly away from the electrodes 26, the spherical body 30 cannot travel upwardly, because it is restrained by the cover 16. The mercury 28, however, will attempt to extrude upwardly through a restriction in the form of an annular passage 36 formed between the outer periphery of the spherical body 30 and the inside surface 32 of the chamber 14 (see FIG. 2). That restriction 36 imposes a downward friction force on the upwardly flowing mercury, thereby impeding its flow.

The combination of that friction force and the aforementioned downward surface tension forces imposed by the spherical body 30 upon the mercury mass 28 provides a considerable restriction to the mercury flow and, assuming that the shock is of relatively short duration, prevents the mercury mass from losing contact with the terminals 26.

When the switch 10 is tilted from the vertical V, the mercury mass behaves in a manner similar to conventional mercury tilt switches by shifting away from the terminals 26. For instance, when the switch 10 tilts by an acute angle B from vertical (see FIG. 3), the mercury mass shifts slightly while keeping contact with the terminals 26. Also, the mercury mass continues to underlie the spherical body 30 and push the latter upwardly against the cap 16 and the inner surface 32 of the chamber.

When the switch tilts by a certain obtuse angle C from the vertical (see FIG. 4), the mercury mass moves out of contact with the terminals 26 to break the electric circuit, and pushes the ball upwardly toward the glass seal end of the switch.

Since the outer peripheral surface of the spherical body is convexly curved as viewed in longitudinal section, it is able to freely roll upon the surfaces of the cap 16, housing 12 and glass seal 18 as the tilting takes place. Thus, there occurs minimal frictional resistance to the travel of the spherical body, and there is no appreciable risk of the spherical body becoming stuck within the housing.

When the switch is in a vertical posture (see FIG. 1), the surface 40 of the mercury mass 28 should preferably lie below the horizontal center plane P of the spherical body 30. Most preferably, the vertical distance S between the center plane P and the mercury surface 40 will be about one-fourth of the diameter of the spherical body 30.

In one practical embodiment of the present invention, the inside diameter of the chamber 14 is about 0.275 inches, the diameter of the spherical body 30 is about 0.25 inches, the length or height L of the chamber 14 is about 0.325 inches, and the spacing S between the center plane P of the spherical body 30 and the height of the mercury 40 when the switch is in the FIG. 1 position is about 0.06 inches. Such a switch can be designed to be in a closed (i.e., electrically conducting) position when vertically oriented as shown in FIG. 1 with the spherical body 30 being pushed against the cap 16, and opened when the switch has been rotated through an obtuse angle (for example 135°) to the position depicted in FIG. 4. When the switch is rotated from the FIG. 4 open position back toward the FIG. 1 position, the switch will re-close prior to the point at which the switch reaches the FIG. 1 position, i.e., at acute angle C (e.g., at about 45°) as shown in FIG. 3. Such a switch could be utilized, for example, as a back-up indicator for the landing gear of an aircraft to provide an indication of the inclination of the landing gear relative to vertical. Of course, the switch can be designed to open and close at any desired angles.

It will also be appreciated by those skilled in the art that other arrangements of the terminals 26 are possible. For example, it is possible to position only one of the terminals 26 at the bottom of the switch and to provide the other terminal elsewhere in the switch, or to utilize the housing of the switch as the second terminal. Also, the switch could be designed so as to be in an open (i.e., non-conducting) position when vertically oriented, whereby the switch would be closed when swung to another position, for example, the FIG. 4 position.

In use, the spherical body 30 is pushed against the top of the chamber 14 by the buoyancy forces imposed by the mercury mass 28. If the switch should be subjected to a shock in a direction tending to cause the spherical body 30 and the mercury mass 28 to be displaced upwardly, no displacement of the spherical body is possible, since that body abuts the cap 16. Displacement of the mercury mass through the passage 36 is possible, but such displacement is resisted by the downward surface tension applied to the mercury mass by the spherical body, as well as by the frictional resistance encountered by the mercury mass as it attempts to pass through the restricted passage 36.

FIG. 2 depicts the switch in a condition where the switch has been subjected to such a shock, and some of the mercury mass has passed through the passage 36, thereby compressing the air in the space above the mercury mass to displace the spherical body slightly downwardly. When the forces of the shock have been fully dissipated, the mercury mass and spherical body will reassume the positions depicted in FIG. 1.

As the switch continues to rotate, the mercury mass will continually be displaced toward the lower end of the chamber 14, thereby forcing the spherical body 30 upwardly by the buoyancy forces. Hence, as depicted in FIG. 3 the spherical body will arrive at a position abutting both the cap 16 and the inside surface 32 of the housing 12. Eventually, the switch may reach a predetermined position wherein the mercury no longer contacts both of the terminals 26 so as to be in a switch-open position depicted in FIG. 4. In the FIG. 4 position the angle C could be 135°, for example.

Due to the surface tension conditions of the mercury, the switch will be in a closed condition during the phase of travel from FIG. 1 to FIG. 4, but during the reverse rotation of the switch, the switch will remain in an open position from the FIG. 4 position to an intermediate position between the FIG. 4 and FIG. 1 positions. For example, the angle B could be 45°.

The housing 12 can be formed of Kovar ® with a nickel plating thereon, whereby at least the inside surface 32 thereof is non-mercury wettable. The terminals 26 could be subjected to a hot tin dip so as to be mercury wettable. The spherical body 30 can be made of any suitable material which is electrically non-conductive, non-mercury wettable, and of less density than mercury, such as plastic.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A tilt switch comprising a housing forming a closed internal chamber, an electrically conductive liquid of less volume than said chamber disposed within said chamber, and electric terminal means arranged to be electrically interconnected by said liquid when said switch is in a first position relative to vertical, said liquid breaking the electric connection when said switch is tilted to a second position relative to vertical, and a body of less density than said liquid floating on a surface of said liquid and being pushed upwardly against a surface of said chamber by said liquid, said body having a non-electrically conductive outer surface and being of smaller cross section than said chamber to define restriction passage means for inhibiting the flow of said liquid therepast when said switch is subjected to shock.

2. A tilt switch according to claim 1, wherein said outer surface of said body is convexly curved as said body is viewed in longitudinal section along a longitudinal axis of said switch.

3. A tilt switch according to claim 1, wherein said liquid comprises mercury.

4. A tilt switch according to claim 1, wherein said chamber is defined by a cylindrical inner surface portion and two opposite end surface portions.

5. A tilt switch according to claim 4, wherein said electric terminal means comprises two terminals extending through one of said end surface portions.

6. A tilt switch according to claim 1, wherein said body is formed of plastic.

7. A tilt switch comprising a housing forming a closed internal chamber, an electrically conductive liquid of less volume than said chamber disposed within said chamber, and electric terminal means arranged to be electrically interconnected by said liquid when said switch is in a first position relative to vertical, said liquid breaking the electric connection when said switch is tilted to a second position relative to vertical, and a substantially spherical body of less density than said liquid floating on a surface of said liquid and being pushed upwardly against a surface of said chamber by said liquid, said substantially spherical body having a nonelectrically conductive outer surface and being of smaller cross-section than said chamber to define restriction passage means for inhibiting the flow of liquid therepast when said switch is subjected to shock.

8. A tilt switch according to claim 7, wherein said chamber is defined by a cylindrical inner surface portion and opposing end surface portions, a diameter of said cylindrical inner surface portion being larger than an outer diameter of said substantially spherical body.

9. A tilt switch according to claim 8, wherein said terminals extend through one of said end surface portions.

10. A tilt switch according to claim 7, wherein a surface of said liquid is disposed below a horizontal center plane of said substantially spherical body.

11. A tilt switch according to claim 7, wherein said liquid comprises mercury.

12. A tilt switch according to claim 7, wherein said substantially spherical body is formed of plastic.

13. A tilt switch comprising:

a housing having a cylindrical inner surface of a first diameter;

a cap affixed to, and closing off, one end of said housing and including a first end surface;

a glass seal affixed to, and closing off another end of said housing and including a second end surface;

said cylindrical inner surface and said first and second end surfaces forming an internal chamber;

first and second electrical terminals extending through said glass seal and communicating with said chamber;

an electrically conductive liquid of less volume than said chamber disposed in said chamber and arranged to electrically interconnect said terminals when said switch is in a first position relative to vertical, said liquid flowing out of contact with at least one of said terminals when said switch is tilted by more than ninety degrees from said first position to a second position relative to vertical; and a substantially spherical body of less density than said liquid and including a non-electrically conductive outer surface, said substantially spherical body floating upon a surface of said liquid and being pushed upwardly against at least one of said surfaces defining said chamber;

said outer surface of said substantially spherical body defining a second diameter smaller than said first diameter to define restriction passage means for inhibiting the flow of liquid therepast when said switch is subjected to shocks;

said surface of said liquid being disposed below a horizontal center plane of said substantially spherical body.

* * * * *